United States Patent [19]

Magnus et al.

[11] 4,436,448

[45] Mar. 13, 1984

[54] EXCAVATING MACHINE FOR TUNNELS AND GALLERIES

[75] Inventors: Wolf Magnus, Tangstedt-Wilstedt; Otto Braach, Heiligenhaus; Dirk Fischer, Burgwedel; Werner Wippig, Lehrte, all of Fed. Rep. of Germany

[73] Assignees: Hochtief AG, vorm. Gebr. Helfmann, Essen; Bade & Theelen GmbH, Lehrte, both of Fed. Rep. of Germany

[21] Appl. No.: 220,462

[22] Filed: Dec. 29, 1980

[30] Foreign Application Priority Data

Dec. 29, 1979 [DE] Fed. Rep. of Germany ..... 2952744

[51] Int. Cl.[3] ..... E02D 9/06

[52] U.S. Cl. ..... 405/143; 405/147

[58] Field of Search ..... 405/141, 143, 145, 147, 405/302; 299/31

[56] References Cited

U.S. PATENT DOCUMENTS 3,379,024 4/1968 Wohlmeyer ..... 405/143 X 3,613,379 10/1971 Jacobs ..... 405/145 X 3,919,851 11/1975 Plourde ..... 405/143

FOREIGN PATENT DOCUMENTS 1225686 9/1966 Fed. Rep. of Germany ..... 405/141

2431652 6/1978 Fed. Rep. of Germany .

*Primary Examiner*—David H. Corbin

*Attorney, Agent, or Firm*—Karl F. Ross; Herbert Dubno

[57] ABSTRACT

A tunnel excavating machine for generating tunnels and galleries in subterranean structures, comprises in addition to the excavating head, a shield which travels with the head and advances along the excavation and lines the tunnels wall at least temporarily. According to the invention, the shield is formed by at least two shield sections which are preferably cylindrical and can be axially spaced apart while being bridged by a seal for the gap between them. The two shield sections are connected by a plurality of angularly equispaced piston-and-cylinder arrangements preferably of the double-acting type to allow angular offsetting of the axes of the two shield sections.

2 Claims, 6 Drawing Figures

EXCAVATING MACHINE FOR TUNNELS AND GALLERIES

FIELD OF THE INVENTION

Our present invention relates to an excavating machine for tunnels and galleries and, more particularly, to a machine for excavating passages in subterranean structures of a generally circular cross section, especially for use as service tunnels and the like, although the invention is applicable to the formation of tunnels and galleries of other shapes and for other purposes, e.g. for mining and vehicular tunnels.

BACKGROUND OF THE INVENTION

In modern excavations to form tunnels, galleries and like elongates passages in subterranean formations, the use of tunneling machines is playing an ever increasing role. Such machines can comprise a head which is advanced in the desired direction against the face of the subterranean structure to be excavated and provided with excavating tools to break away the structure and form a detritus which is carried by conveyors of the machine rearwardly to be discharged out of the path of the head.

The excavating head is generally followed by a support structure which braces the machine so that the head can be advanced relative to the support which can then be drawn forwardly so that the next stage of advance of the head can be effected.

In addition, the machine can be provided with a shield which can surround the operating mechanism and can provide temporary support for the tunnel walls until finishing action, e.g. lining with concrete, grouting or the like, is undertaken. Generally the shield of the machine is advanced with the excavating head and comprises a cylindrical shell which lies close to the wall previously formed by the excavating head.

The shield can be coupled to the head for advance through the tunnel as it is formed. The shield can include at least two axially separated annular shell sections which are adjustably coupled together, and a so-called pressure ring can be provided. The two shell sections are bridged by a sealing member and the connecting elements may be distributed about the periphery of the shell sections, i.e. angularly equispaced therearound.

Machines of this type are known, for example, from German Pat. No. 24 31 652.

In general the shield constituted by one or more of such annular shell sections is advanced relative to the pressure ring through the excavated tunnel stretch by a cylinder arrangement.

The connecting elements described are generally screw-type members of a turnbuckle or equivalent configuration having nuts adjusting the effective lengths of these elements between two anchor points on the respective shell sections.

As a result, the screw-type members must be capable of resisting the forces which are generated as the shield is advanced, these forces being tension forces when the leading shield sections is advanced and the other section is drawn along.

The contacting elements allow a passive adjustment of the positions of the two shield sections relative to one another in terms of the angle between the respective axes of the shield sections by reducing the effective lengths of some of the connecting elements while increasing the effective lengths of others. An active adjustment is not possible and each adjustment of each element must be done by hand.

The mentioned angles between the axes of the shield sections are those which arise especially when the machine is advanced along an arcuate or curved path or indeed any path deviating from a straight line.

Where any adjustment of this angle is required, therefore a considerable amount of hand labor is involved.

OBJECT OF THE INVENTION

It is the object of the present invention to provide, in an excavating machine of the type described, an improved shield assembly and especially an arrangement for mutually adjusting the positions of shield sections so that the amount of manual labor required is minimized.

SUMMARY OF THE INVENTION

This object and others which will become apparent hereinafter are attained, in accordance with the present invention, in an excavating machine of the type described having an excavating head, pressure ring and shield and in which the shield is divided into two shell sections bridged by a seal, the connecting elements being constituted as hydraulic piston-and-cylinder arrangements braced at opposite ends against the two sections and spanning the gap and seal between them. Preferably, these piston-and-cylinder arrangements, hereinafter referred to simply as hydraulic cylinders, are of the double-acting type.

The invention is based upon our discovery that the screw-type connecting elements hitherto used can be effectively replaced by fluid responsive members such as hydraulic cylinders without any loss of adjustability or effectiveness and indeed with surprising advantages, especially when the hydraulic connecting cylinders are of the double-acting type. Such cylinders can withstand the considerably stresses to which the connecting elements are subject without difficulty and can provide active adjustment of the positions of the two shell sections or passive accommodation to the tunnel orientation in a particularly simple manner.

For active control it is merely necessary to provide each of the hydraulic connecting cylinders with a respective control valve and to regulate the pressures on opposite sides of the piston of each valve to intentionally vary or reduce the effective length of the fluid-responsive element.

In this case, one of the sections is actively displaced relative to the other. For this purpose, the hydraulic cylinders can be supplied from a common pressure source via respective hydraulic lines which can be provided with the respective control valve.

For passive adjustment, e.g. to follow the contour of the tunnel, as, for example, when the tunnel curves, the hydraulic cylinders are connected in parallel in a closed hydraulic network so that, as the effective length of some of the cylinders increases, the effective length of others is reduced correspondingly.

When double-acting cylinders are provided, each of the cylinders will have a piston subdividing the cylinder chamber into two working compartments one of which can be considered to be the forward-drive compartment while the other is considered to be the trailing compartment. The forward drive compartment can be pressurized to advance one of the shield sections forwardly along the excavation. In this case, all of the advance drive compartments are connected together in one hydraulic network while all of the trailing compartments are connected together in a second hydraulic network which thus provides automatic compensatory displacement of the pistons of all of the cylinders. The conventional screw-type connecting members can thus be entirely eliminated along with them the expensive manual adjustments hitherto required.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 2:
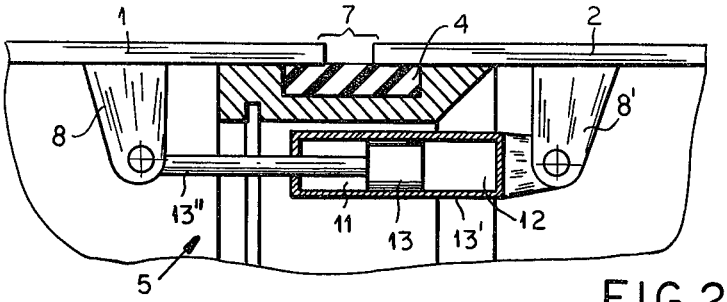
FIG. 2 is a detail view, greatly enlarged in scale, of the region 11 of FIG. 1.
Figure 1:
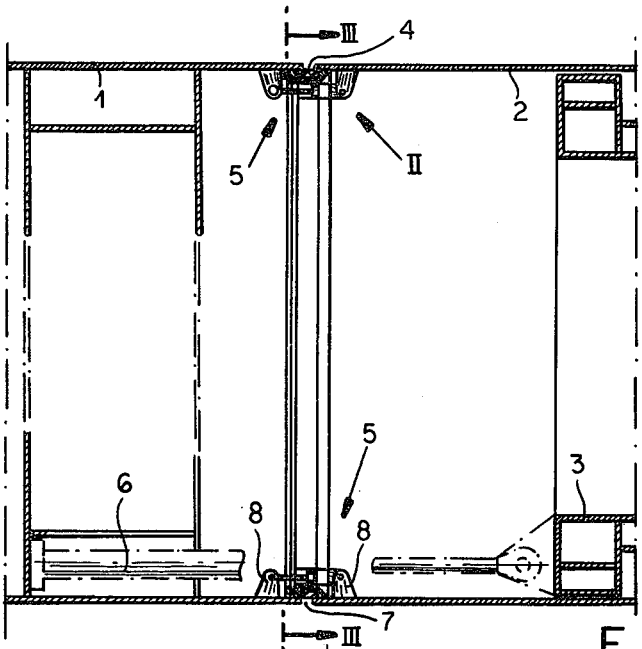
FIG. 1 is an axial section through the shield of a tunnel excavating of the type described showing the improved connecting assembly of this invention.
Figure 3:
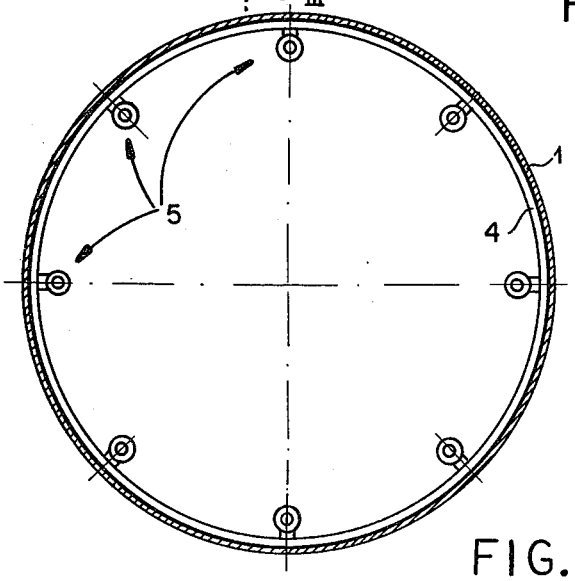
FIG. 3 is a section taken along the line III—III of FIG. 1.

The tunnel excavating machine, represented in part in the drawing, is intended for the excavation of circular cross-section tunnels and galleries. The excavating tools of the excavating head, i.e. the rotary pick assembly, the conveyor system for removing the excavated detritus, and the support relative to which the head is advanced, all part of the excavating machine, have not been illustrated since they are of conventional design as described in the aforementioned patent.

In addition, the excavating machine comprises a shield having two cylindrical shield sections 1 and 2, and a pressure ring 3.

The shell sections 1 and 2 form a gap 7, which is bridged by a seal 4, and are connected by angularly equispaced connecting elements 5. The piston-and-cylinder arrangements 6 which connect the shield to the pressure ring have been represented in dot-dash lines and in a conventional manner serve to advance the shield in the direction of excavation of the tunnel.

As can be seen in detail in FIG. 2, each of the connecting elements 5 comprises a hydraulic piston-and-cylinder arrangement or, more particularly, a hydraulic cylinder whose piston 13 subdivides the cylinder chamber into two compartments 11 and 12. The piston rod 13' can be pivotally connected to a support 8 of the shell section 1 while the cylinder body 13'' is pivotally connected to the support 8' of the shell section 2.

Thus the hydraulic cylinders 11–13 each bridge the gap 7 which is also spanned by the seal, the latter having an axial length at least equal to the maximum excursion permitted between the confronting edges of the gap by the hydraulic cylinders 11–13 and sufficient flexibility to permit angular offsetting of the axes of the two sections in the manner described.

Figure 6:
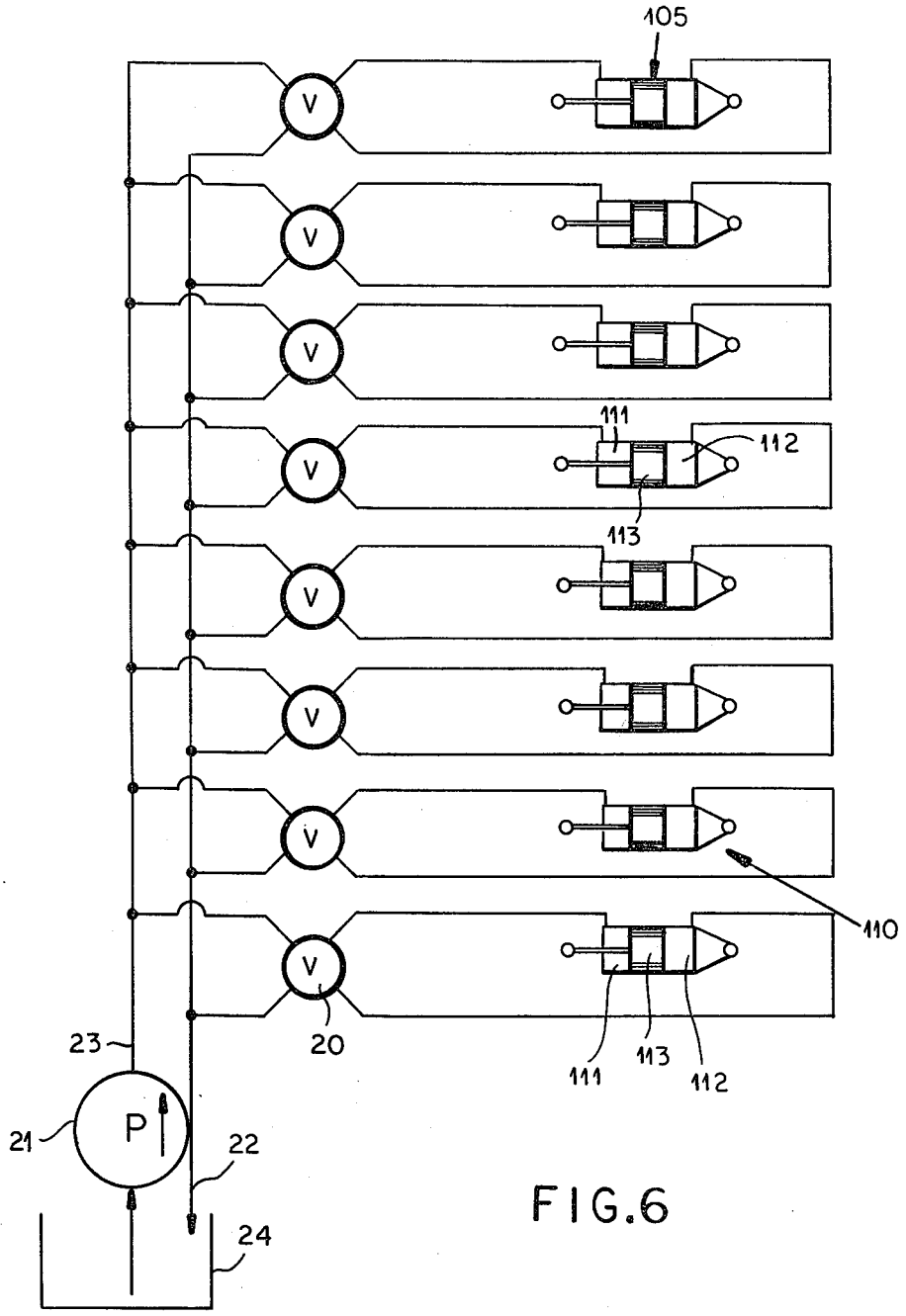
FIG. 6 is a diagram showing individual operation of the hydraulic cylinders.

As can be seen from FIG. 6, the hydraulic cylinders can be individually adjusted thereby enabling one of the shell sections 1 to be actively displaced angularly relative to the other. In this embodiment, the advance drive compartments 111 of the cylinders 105 are connected in a hydraulic network 110 through respective four-port three-position valve 20 to the pressure line 23 of a pump 21 serving as the hydraulic fluid source. A return line 22 runs to the reservoir 24.

Each of the valves 20 has a first position connecting the pressure line 23 to its compartment 111 while the compartment 112 is connected via the line 22 to the reservoir 24, a second position in which the trailing compartment 112 is connected to the pressure line 23 while the forward drive compartment 111 is connected to line 22 running to the reservoir, and a third position in which fluid communication to and from the compartments 111 and 112 is cut off and hence the piston 113 is immobilized.

Figure 4:
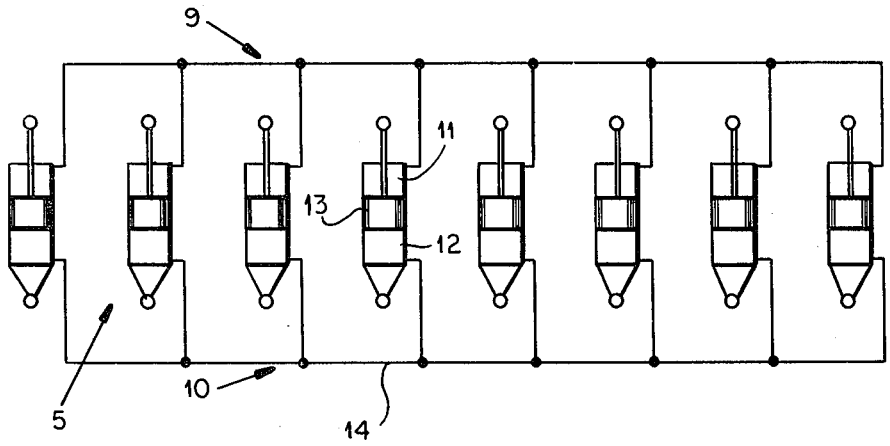
FIG. 4 is a diagram illustrating a compensating hydraulic connection of the hydraulic cylinders of FIGS. 1 through 3 in accordance with one embodiment of the invention.
Figure 5:
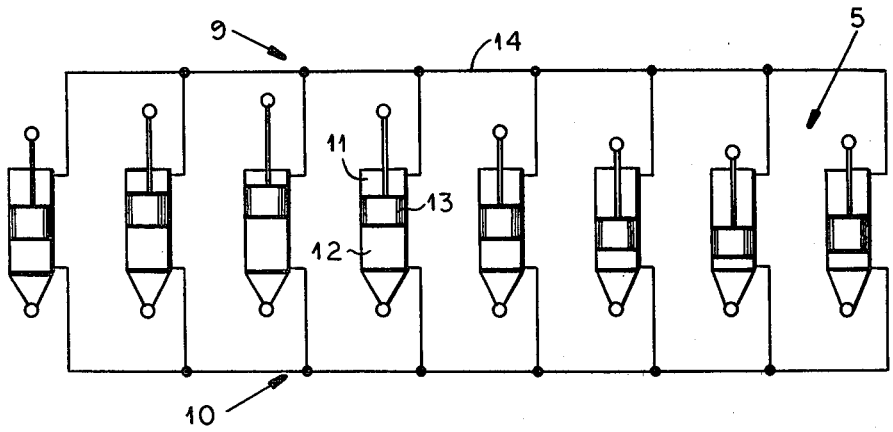
FIG. 5 is a similar view of these cylinders in another functional position.

Alternatively, the two shell sections 1, 2 may be self-compensating in which case, as in FIGS. 4 and 5, they are hydraulically connected in parallel in a closed hydraulic network 9, 10.

The double-acting cylinders 5 here have forward drive side cylinder compartments 11 connected together in one network section 9 while the trailing side compartments 12 are connected in the other network section 10 with two sections being interconnected through the pistons 13.

As one of the sections tilts relative to the other, the pistons 13 are shifted from their central position (FIG. 4) to offset position (FIG. 5) compensatorily. The FIG. 5 position, of course, represents movement of the shield over a curved path. There is no net change in the volumes of the forward drive compartments in toto or of the volumes of the trailing compartments in toto during this compensatory movement in spite of the fact that all stresses can be taken up by the cylinders.

We claim:

1. In a machine for excavating tunnels and galleries and comprising a shield advanced along an excavated stretch by hydraulic means braced against a pressure ring, the improvement wherein said shield comprises in combination:

at least two annular shell sections separated axially from one another and defining a separation gap;

a seal bridging said gap;

a plurality of peripherally spaced piston-and-cylinder arrangements bridging said gap and braced at opposite ends against said shell sections, each of said piston-and-cylinder arrangements being a double-acting hydraulic cylinder; and means forming at least one closed passive hydraulic network and connected to said piston-and-cylinder arrangements to connect said double-acting cylinders in parallel for enabling variation in the effective lengths thereof to permit angular offsetting of axes of said shell sections.

2. The improvement defined in claim 1 wherein each of said cylinders has a piston subdividing the same into a forward compartment and a trailing compartment in the direction of advance of said shield and in the opposite direction, respectively, all of said forward compartments being connected to one closed hydraulic network and all of said trailing compartments being connected to a second closed hydraulic network.

* * * * *